US005158073A

United States Patent [19]

Bukowski

[11] Patent Number: 5,158,073

[45] Date of Patent: Oct. 27, 1992

[54] ACUPRESSURE FOOT MASSAGE MAT

[76] Inventor: Voytek Z. Bukowski, 8451 E. Doris St., San Gabriel, Calif. 91775

[21] Appl. No.: 629,376

[22] Filed: Dec. 18, 1990

[51] Int. Cl.[5] ..... A61H 39/04

[52] U.S. Cl. ..... 128/25 B; 128/24 R; 606/204

[58] Field of Search ..... 128/24 R, 24 B, 67; 5/417; 606/201, 204

[56] References Cited

U.S. PATENT DOCUMENTS

| | | | |
|---|---|---|---|
| D. 194,285 | 12/1962 | Altmeyer et al. . | |
| D. 280,868 | 10/1985 | Russell . | |
| D. 283,052 | 3/1986 | Eugster . | |
| D. 294,212 | 2/1988 | Sias et al. . | |
| 2,079,311 | 5/1937 | Blumenthal | 128/25 B |
| 2,853,399 | 9/1958 | Shoults | 5/417 X |
| 3,107,665 | 10/1963 | Nordgren | 128/67 |
| 3,434,715 | 3/1969 | Brantingham et al. | 5/417 X |
| 3,744,483 | 7/1973 | Picolin | 128/67 X |
| 3,885,555 | 5/1975 | Nobbs | 128/25 B |
| 4,233,966 | 11/1980 | Takahashi | 128/67 |
| 4,383,342 | 5/1983 | Forster | 5/417 X |
| 4,399,574 | 8/1983 | Shuman | 5/417 |
| 4,974,582 | 12/1990 | Johnson | 128/67 X |

*Primary Examiner*—Robert A. Hafer
*Assistant Examiner*—Sam Rimell
*Attorney, Agent, or Firm*—Albert O. Cota

[57] ABSTRACT

An acupressure foot massage mat (10) that is molded of a resilient material and consists of an upper surface (12) and a non-slip lower surface (16). On the upper surface are randomly located a multiplicity of cone shaped protrusions (14) that are designed to apply an optimum pressure-point contact to the body. The mat (10) is primarily designed to be placed on a flat surface to provide an acupressure massage when a user walks on the mat. However, it can also be hung on a wall or draped over a chair or automobile seat to apply a massage to the buttocks and back. The mat design also incorporates an attachment means that allows two or more mats to be joined so that several persons can obtain an acupressure massage at the same time.

2 Claims, 3 Drawing Sheets

ACUPRESSURE FOOT MASSAGE MAT

TECHNICAL FIELD

The invention pertains to the general field of acupressure therapy and implements and more particularly to an acupressure implement consisting of a foot massage pad that allows selected zones of the foot or the entire foot to be massaged.

BACKGROUND ART

Acupressure therapy is closely related to the field of acupuncture which is conservatively estimated to be more the 2,000 years old. Acupuncture therapy is based on the concept that the human body has an internal set of channels or meridians that surface onto the skin at 365 points. These meridian points are places where control of functional body areas can best be exercised and effected by the insertion of needles.

The concept of acupressure, which is also referred to as reflexology massaging, utilizes the thumb, knuckle or some other external mechanical or electrical massaging implement to apply pressure to the selected meridian points. In the methodology of acupressure, as in acupuncture, there is taught that there are various organs, nerves and glands in the body that are connected with certain "reflex areas" located on the bottom of the feet, the hands and other meridian related areas of the body. By massaging these reflex areas and through resulting stimulating response, therapeutic help for various body ailments and pain reduction can be obtained.

Over the years, considerable substantiation has been given to acupressure and reflexology massaging. Therefore, many practitioners are now using "acupressure" in lieu of "acupuncture" to relieve ailments or reduce pain.

A search of the prior art disclosed various patents that covered acupressure devices and implements but none that read directly on the claims of the instant invention. However, the following U.S. patents were considered related:

| U.S. PAT NO. | INVENTOR | ISSUED |
|---|---|---|
| D294,212 | Sias et al | 16 February 1988 |
| D283,054 | Eugster | 18 March 1986 |
| D280,868 | Russell | 8 October 1985 |
| D194,255 | Altmeyer et al | 18 December 1962 |

The Siai patent discloses a seating pad that is constructed of a resilient material. On the top of the pad is located a multiplicity of identical hemispherical protrusions that when a person is seated provide pressure points to the buttock area. On the bottom of the pad are located a multiplicity of truncated cones that provide a non-slip surface.

The Eugster patent discloses a foot pedal massager that would be placed over a foot pedal such as used to operate a machine or an automobile. The massager consists of a rectangular pad having outwardly extending protrusions where each protrusion has a distinct and unusual shape. To use the pad, the shoe would be removed and the foot would be placed on the pad to receive an acupressure massage each time the foot applies pressure to the pad.

The Russell patent discloses a foot scrubber constructed on a stable tray that includes side walls to stabilize the foot. On the upper surface of the tray, on each end, is located a plurality of grouped bristles and centrally a plurality of inverted cone like structures. The combination of the bristles and structure allows a person to effectively scrub their feet.

The Altmeyer patent discloses a foot exerciser consisting of a floor mat in a substantially oval shape. The bottom of the mat includes a non-slip surface and the top includes a three-section design. The two outer end sections include a multiplicity of protrusions of one size, a center area having protrusions of a larger size and a side area having a multiplicity of yet smaller protrusions. The different size protrusion allow a user to select an area or a combination area that feels best to the foot.

DISCLOSURE OF THE INVENTION

The use of acupressure massage is firmly rooted and practiced in Chinese traditional medicine. One of basic teachings of this ancient practice is that certain pressure points on the soles of the feet are closely connected and affect the general health of many organs and glands in the human body. The acupressure massaging of these pressure points on the feet stimulates the movement and circulation of "vital power" that beneficially treats the corresponding organs and/or glands.

The acupressure foot massage mat is designed to allow an individual to perform, without assistance, an acupressure massage on the foot. Although the mat is particularly designed to provide a foot massage, the buttocks and/or the back can also be massaged. This additional massage use is easily accomplished by hanging the mat on a wall or by draping the mat over a chair or an automobile seat. The use of a mat when driving over long periods of time is especially beneficial for reducing fatigue and maintaining a comfortable during position.

The mat in its preferred embodiment is molded in one-piece of a resilient plastic material. The mat has a lower non-slip surface and an upper surface that includes a multiplicity of cone shaped protrusions. The protrusions are designed to apply an optimized pressure point contact to the body. On the top surface is also located protrusion-free sections that allow a mat user to selectively exclude specific areas of the foot from being subjected to acupressure. The mat may also include along its edge(s) an attachment means, such as a tongue and groove fastener, that allows two or more mats to be joined. The joined mats provide a larger surface that can be used by several persons simultaneously.

In view of the above disclosure, it is the primary object of the invention to provide a convenient and effective method to effect an acupressure massage to the feet. In addition to the primary object, it is also an object of the invention to provide an acupressure massage mat that:

- allows a mat user to select an area on the mat that will massage all the foot or to select an area that will massage only a specific section of the foot,
- is easily moved to thus allow the mat to be placed and used in any convenient location,
- can also be used to apply an acupressure massage to other parts of the body. For example, when the mat is hung on a wall or draped over a chair or automobile seat, the buttocks and/or the back can be massaged.
- allows several mats to be attached from any side to provide a larger mat that can be used simultaneously by several persons,
- can be made in a variety of colors and resilient materials, and is cost effective from both a manufacturing and consumer point of view.

These and other objects and advantages of the present invention will become apparent from the subsequent detailed description of the preferred embodiment and the claims taken in conjunction with the accompanying drawings.

BEST MODE FOR CARRYING OUT THE INVENTION

The best mode for carrying out the invention is presented in terms of a preferred embodiment that is primarily designed to provide an easy and comfortable way and method to provide an acupressure massage to the bottom of the foot. The mat 10 as shown in FIGS. 1 through 13 is comprised of a single mat that has an upper surface 12 and a flat lower surface 16, as shown in FIGS. 1 and 2 respectfully.

Figure 3:
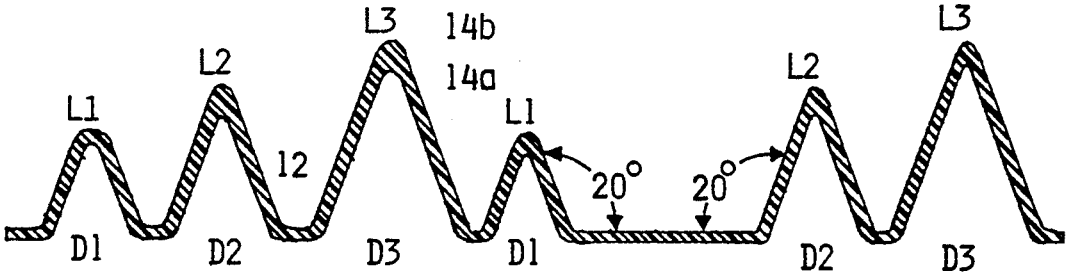
FIG. 3 is a cross-sectional view showing the three different lengths and diameters of the conic protrusions.
Figure 4:
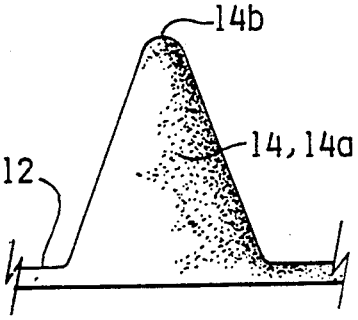
FIG. 4 is an elevational view of one of the conic structure with a rounded apex.

The mat's upper surface 12 includes a multiplicity of protrusions 14 that preferably are shaped as conic protrusions **14*a* that have a rounded apex 14*b* as shown in FIGS. 3 and 4**. A conic protrusion is preferred over other protrusion shapes because it provides an optimum point contact to the areas of the foot that are to be massaged by acupressure. The mat including the conic protrusions is molded in one piece out of a resilient material such as plastic or rubber with a polyvinylchlorite (PVC) plastic material preferred. The PVC material has an optimum resiliency that allows a firm point pressure to be applied to the skin without danger of bruising the skin or causing undue pain.

Figure 1:
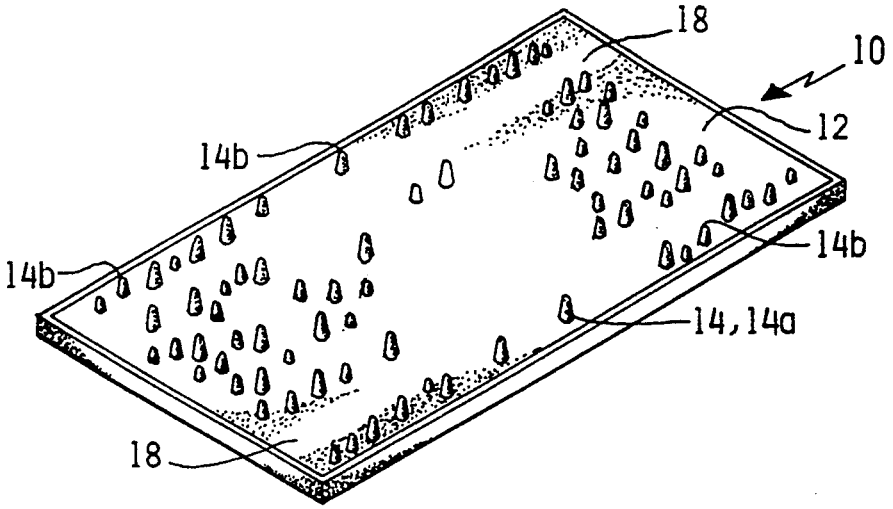
FIG. 1 is a perspective view showing the upper surface of the acupressure foot massage mat.
Figure 2:
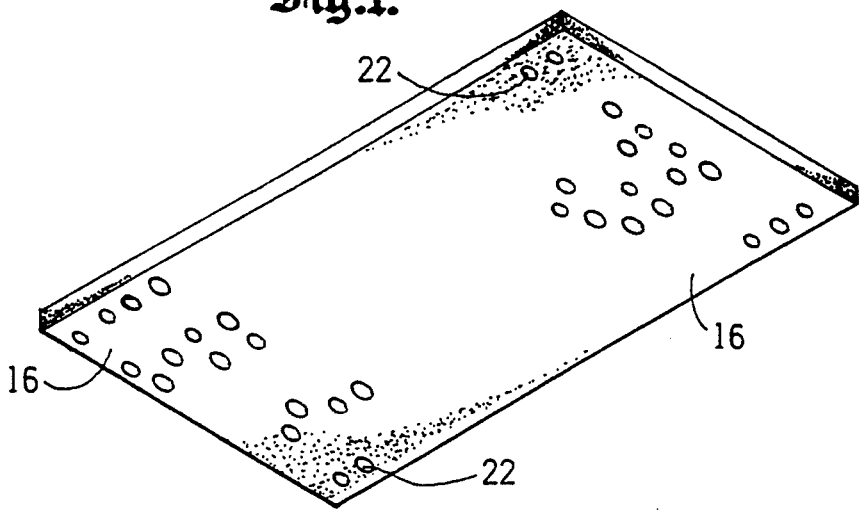
FIG. 2 is a perspective view showing the bottom surface of the mat.
Figure 5:
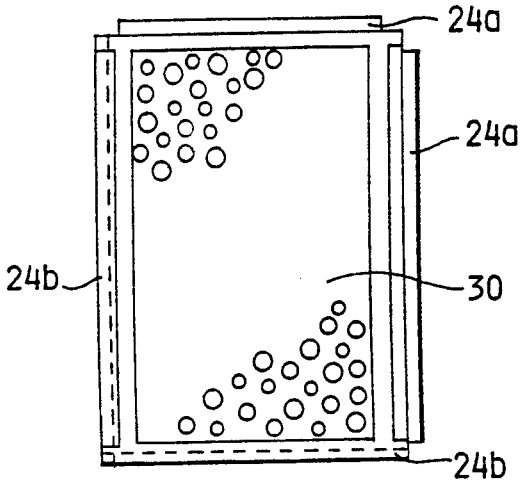
FIG. 5 is a plan view of a mat in a substantially rectangular shape having four protrusion-free channels and a tongue and groove fastener along its sides.
Figure 6:
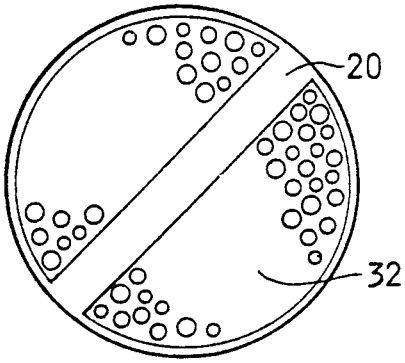
FIG. 6 is a plan view of a mat in a substantially circular shape having an angular protrusion-free channel.
Figure 7:
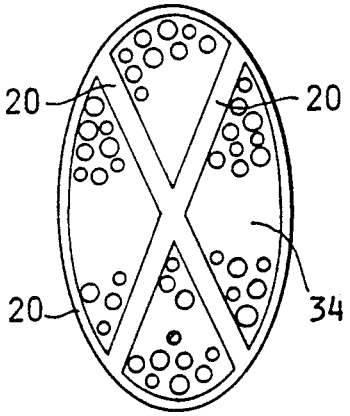
FIG. 7 is a plan view of a mat in a substantially oval shape having a pair of crossing channels.
Figure 8:
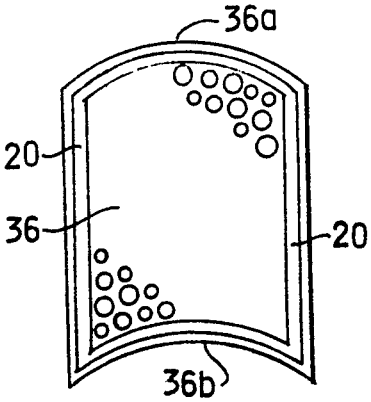
FIG. 8 is a plan view of a mat in a rectangular shape that has one of its narrow ends in a convex shape and the opposite narrow end in a concave shape and that includes a protrusion-free channel that follows the contour of the mat.

The mat 10 in its preferred embodiment is configured in a rectangular shape 30 as shown in FIGS. 1, 2 and 5. However, the mat may also be made in a circular shape 32 as shown in FIG. 6, an oval shape 34 as shown in FIG. 7 or in a rectangular chevron shape 36 with one of the narrow end having a convex shape **36*a* and the opposite narrow end having a concave shape 36*b* as shown in FIG. 8. In all the above shapes, the multiplicity of conic structures 14*a* extend upwardly and are dispersed throughout the mat 10 in a random pattern as shown in FIGS. 1, and 3. Additionally, the conic protrusions 14*a* are comprised of at least two different diameters and at least two different lengths. In its preferred embodiment, the angle of the conic section is 20° and there are three different diameters D1, D2 and D3 as best shown in FIG. 3 and three different lengths L1, L2 and L3 as also best shown in FIG. 3**.

Figure 10:
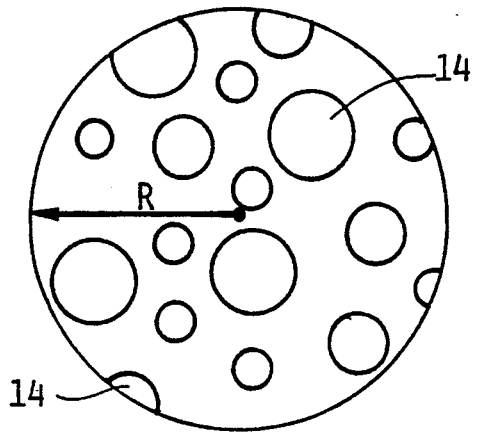
FIG. 10 is a plan view of a mat illustrating that on any portion of the mat within an area circumvented by a radius of 1.5 inches the feet will encounter a mix of protrusions having at least two different lengths and diameters.
Figure 11:
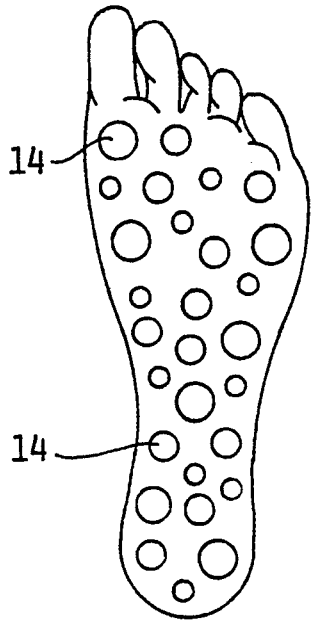
FIG. 11 is a bottom view of a foot showing that when a foot is placed on the mat at least fifty percent of the feet will encounter protrusions.

The random dispersal of the protrusions 14a is designed so that on any portion on the mat 10 that covers an area circumvented by a radius (R) of 1.50 inches (3.85 cm) the foot will encounter a mix of protrusions that have at least two different lengths and two different diameters as shown in FIG. 10. In most cases, the foot over this same area will encounter protrusions having three different lengths and diameters. Additionally, the above dispersal scheme assures that when a foot is placed on the mat, over a protrusion filled area, at least fifty percent of the foot will encounter protrusions as shown in FIG. 11.

Figure 9:
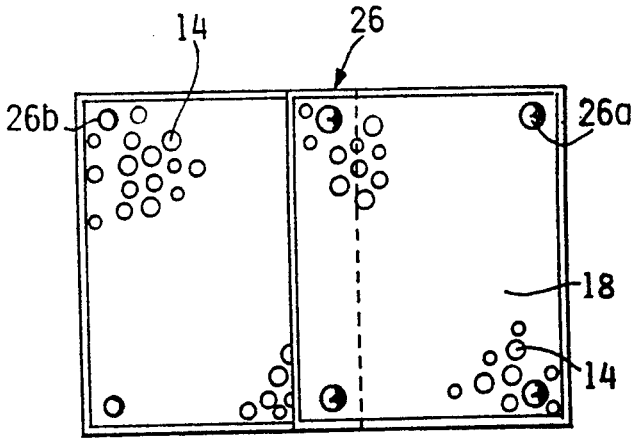
FIG. 9 is a plan view showing two mats attached and with a mix of protrusions that are in a random pattern.

The preferred design of the mat 10 also includes protrusion-free sections 18. These sections 18 allow a mat user to selectively exclude specific areas of the foot from being subjected to acupressure, or conversely to select only areas of the foot where acupressure is desired. The protrusion-free section 18 may be randomly dispersed throughout the top surface of the mat 10 as shown in FIG. 9. Alternatively, the protrusion free sections 18 may be dispersed in at least one channel 20 that traverses the mat longitudinally and at least one channel 20 that traverses the mat 10 horizontally as shown in FIG. 5. Other protrusion-free channel 20 configurations may be designed to angularly traverse the mat or to follow the mats contour as shown in FIGS. 6, 7 and 8.

Figure 12:
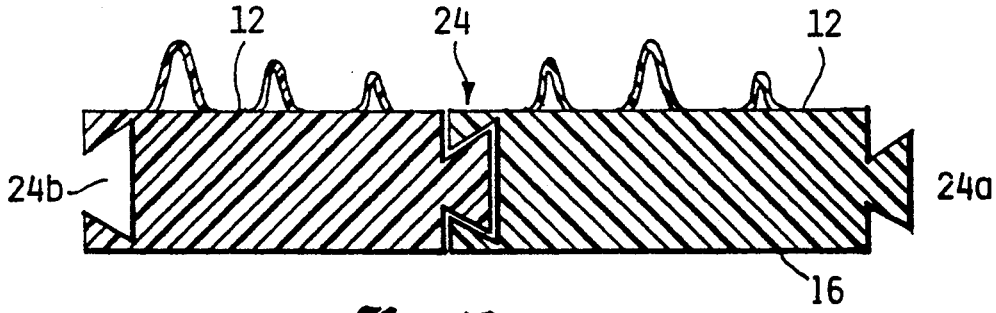
FIG. 12 is a sectional view showing two mats attached by the tongue and groove mat attachment means.
Figure 13:
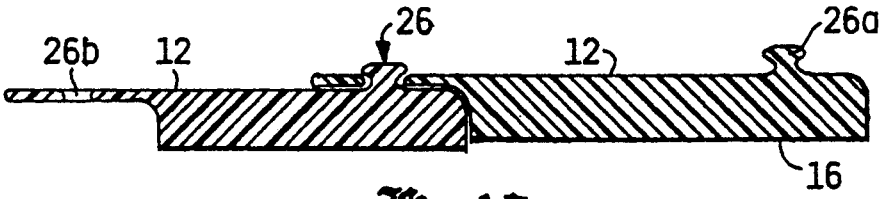
FIG. 13 is a sectional view taken along lines 13—13 of FIG. 9 showing the snap fastening mat attachment means.

In some cases it may be desirable to increase the area of the mat 10 such as in cases when groups of persons will be using the mat simultaneously. For these cases, an attachment means is provided that allows a plurality of mats to be attached along their vertical and/or horizontal edges as shown in FIGS. 9, 12 and 13. For example, a first mat 10 may be attached to a second mat 10 as shown in FIG. 9.

One such attachment means consists of a tongue and groove fastener 24. In this fastening means, as shown in FIGS. 5 and 12, the tongue **24*a* is located on one horizontal edge and on one vertical edge of the mat; the groove 24*b* is likewise located on the opposite horizontal and vertical edges. The tongue and groove fastener 24 may be located over the entire length of the mat as shown in the figures or alternatively, the fastener 24 may be located on only the corners of the mat (not shown). In either case, the insertion of the tongue 24*a* into the groove 24*b* can be facilitated by sprinkling talcum powder, or the like, on the groove prior to inserting the tongue. In a second attachment means, a complimentary snap fastener 26 is used. In this fastening means, as shown in FIGS. 9 and 13, one side 26***a* of the snap fastener is located on two upper corners of the mat 10 and on the opposite lower corner of the mat is located the complimentary sides 26*b* of the fastener 26.

The mat 10 is designed to be placed on any surface such as a rug or a smooth surface. The mat material provides a non-slip surface to avoid any slippage particularly when the mat is placed on a smooth surface. However, to further prevent slippage, the non-slip surface is enhanced by the conic cavities 22 forming the conic shape 14*a* of the protrusions 14. These cavities 22, as best shown in FIG. 2 function as suction cups that temporarily adhere to the smooth surface to thus prevent the mat 10 from slipping.

To use the mat 10 the following three steps are suggested:

1. Place the mat on a flat surface,
2. Walk slowly across the entire surface of the mat three or four times. For persons, with particularly sensitive feet, a towel may be placed on the mat or the user can wear socks, and,
3. Repeat step two several times per day.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. An acupressure foot massage mat comprising:

a) an upper surface whereupon on any portion of said upper surface covering an area circumvented by a 1.50 inch (3.85 cm) radius there is a multiplicity of hollow conic shaped protrusions spaced at irregular intervals and having two different lengths and two different diameters at said upper surface and b) a flat lower surface having cavities formed by the hollow conic shaped protrusions acting as suction caps that adhere to a smooth surface.

2. The mat as specified in claim 1 wherein said protrusions are dispersed so that when an average sized normal adult foot is placed on said mat at least fifty percent of the foot will encounter said protrusions.

* * * * *